United States Patent [19]

Matsuda

[11] Patent Number: 4,572,088

[45] Date of Patent: Feb. 25, 1986

[54] DEVICE FOR GUIDING CONCEALED SLIDE FASTENER STRINGERS TO A SEWING MACHINE

[75] Inventor: Yasuhiko Matsuda, Toyama, Japan

[73] Assignee: Yoshida Kogyo K.K., Tokyo, Japan

[21] Appl. No.: 708,852

[22] Filed: Mar. 6, 1985

[30] Foreign Application Priority Data

Mar. 6, 1984 [JP] Japan ..... 59-32796
Mar. 6, 1984 [JP] Japan ..... 59-32797

[51] Int. Cl.[4] ..... D05B 3/12; D05B 33/02

[52] U.S. Cl. ..... 112/104; 112/114; 112/152; 112/272; 112/113; 112/235

[58] Field of Search ..... 112/104, 113, 114, 152, 112/153, 272, 235

[56] References Cited

U.S. PATENT DOCUMENTS 4,274,347 6/1981 Rohrer ..... 112/104
4,497,270 2/1985 Boser ..... 112/104 X

*Primary Examiner*—H. Hampton Hunter
*Attorney, Agent, or Firm*—Hill, Van Santen, Steadman & Simpson

[57] ABSTRACT

A device for guiding a concealed slide fastener to a sewing machine includes a pair of spaced track bodies mounted on a slanted guide plate and each comprising a block fixedly mounted on the guide plate and a cover member movably mounted on said block. The block and the cover member jointly define a guide channel for guiding an element assembly of the slide fastener therethrough while the slide fastener is fed down the guide plate toward a sewing position on the sewing machine. The guide channel includes a recess for accommodating coupling heads of the element assembly at an inlet end thereof, the recess being shaped for automatically erecting the element assembly from a horizontal position to a vertical position as the element assembly is moved progressively through the guide channel. The guide plate supports a means for sensing an end of the concealed slide fastener.

8 Claims, 19 Drawing Figures

DEVICE FOR GUIDING CONCEALED SLIDE FASTENER STRINGERS TO A SEWING MACHINE

BACKGROUND OF THE INVENTION

1. Field of the Invention

The present invention relates to a device for automatically guiding slide fastener stringers such as concealed slide fastener stringers to the sewing station on a sewing machine for enabling the sewing machine to stitch the supplied concealed slide fastener stringers to fabric pieces as of a garment or a bag.

2. Prior Art

For sewing a concealed slide fastener stringer to a fabric piece on a sewing machine, it is necessary to erect an element assembly on the stringer tape into an unfolded position to expose a fold line so that the fastener stringer can be sewn to the fabric piece along the fold line. To meet this requirement, a presser foot of the sewing machine has a groove for guiding the element assembly in its erected position. However, it has been customary practice to manually unfold and fit the element assembly in the groove in the presser foot. Such a manual procedure is time-consuming and unreliable, needs to be effected by a skilled operator, and is of a limited efficiency.

Where a concealed slide fastener composed of two slide fastener stringers is to be fed to a sewing machine for attachment to a pair of fabric pieces, the presser foot has to be manually lifted to allow the slide fastener to pass therethrough since the slide fastener stringers are connected at a trailing end of the slide fastener. Any other guide devices having guide channels and positioned upstream of the presser foot in the direction of feed of the slide fastener have to be lifted to pass the connected end of the slide fastener therethrough.

SUMMARY OF THE INVENTION

According to the present invention, a device for guiding a concealed slide fastener stringer to a sewing machine includes a track body mounted on a guide plate disposed on the sewing machine. The track body is composed of a block fixedly mounted on the guide plate and a cover member movably mounted on the block. The block and the cover member jointly define a guide channel for guiding an element assembly on the stringer therethrough while the stringer is fed along a path on the guide track toward a sewing position on the sewing machine. The guide channel includes a recess for accommodating coupling heads of the element assembly at an inlet end thereof, the recess being shaped for automatically erecting the element assembly from a horizontal position to a vertical position as the element assembly is moved progressively through the guide channel. The device may be composed of a pair of the track bodies for guiding a concealed slide fastener comprising a pair of slide fastener stringers carrying a slider. The device may also include means for sensing the slider.

It is an object of the present invention to provide a device for guiding a concealed slide fastener stringer to a sewing machine while automatically erecting an element assembly during passage thereof through a guide channel of the device.

Another object of the present invention is to provide a device for guiding a concealed slide fastener to a sewing machine, the device having a means for allowing a connected end of the concealed slide fastener to pass through the device and also a means for sensing a slider of the slide fastener.

Many other advantages and features of the present invention will become manifest to those versed in the art upon making reference to the detailed description and the accompanying sheets of drawings in which preferred structural embodiments incorporating the principles of the present invention are shown by way of illustrative example.

DESCRIPTION OF THE PREFERRED EMBODIMENTS

Prior to describing a guiding device according to the present invention, a concealed slide fastener and a process of attaching the same to a fabric is described with reference to FIGS. 1 through 4.

Figure 1:
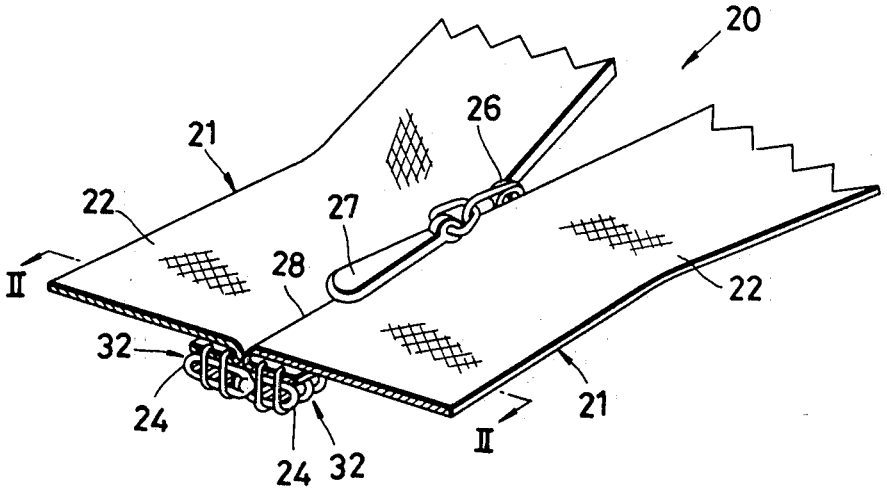
FIG. 1 is a fragmentary perspective view of a concealed slide fastener.
Figure 2:
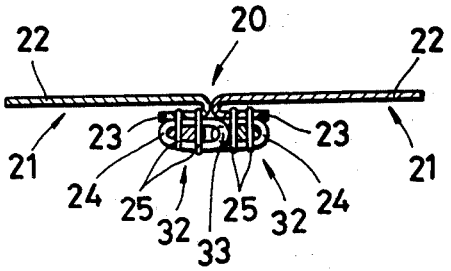
FIG. 2 is a transverse cross-sectional view taken along line II—II of FIG. 1.

As shown in FIGS. 1 and 2, a concealed slide fastener 20 comprises a pair of stringers 21, 21 each composed of a stringer tape 22 having a longitudinal marginal portion 23 folded on itself supporting a row of coupling elements 24 sewn thereto by sewing threads 25. The rows of coupling elements 24 on the stringer tapes 22, 22 are taken into and out of intermeshing engagement with each other by a slider 26 (FIG. 1) slidably mounted on the rows of coupling elements 24. The slider 26 has a pull tab 27 projecting out through a seam-like joint 28 between the folded portions of the stringer tapes 22, 22.

Figure 3:
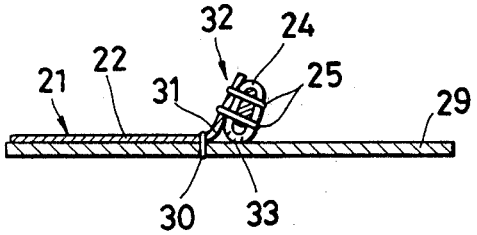
FIG. 3 is a transverse cross-sectional view of a concealed slide fastener stringer sewn to a fabric piece.
Figure 4:
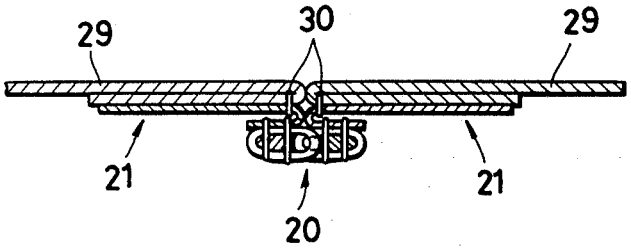
FIG. 4 is a transverse cross-sectional view of a pair of concealed slide fastener stringers sewn to fabric pieces, respectively.

For attaching the concealed slide fastener 20 to a fabric, the slide fastener 20 is opened by moving the slider 26 to separate the stringers 21, 21. As shown in FIG. 3, each of the stringers 21 is sewn to a fabric piece 29 with sewing threads 30 along a fold line 31 of the stringer tape 22. At this time, a coupling element assembly 32 composed of the coupling elements 24 and the marginal tape portion 23 is turned outwardly or erected with coupling heads 33 of the coupling elements 24 being directed downwardly. The sewn fabric piece 29 is then folded back on itself about the sewn threads 30 (FIG. 4). The slide fastener stringers 21, 21 with the fabric pieces 29, 29 stitched thereto are then coupled together by the slider 26 to close the concealed slide fastener 20.

In practice, the slide fastener stringers 21 are sewn simultaneously to fabric pieces on a sewing machine having a pair of parallel sewing needles.

Figure 5:
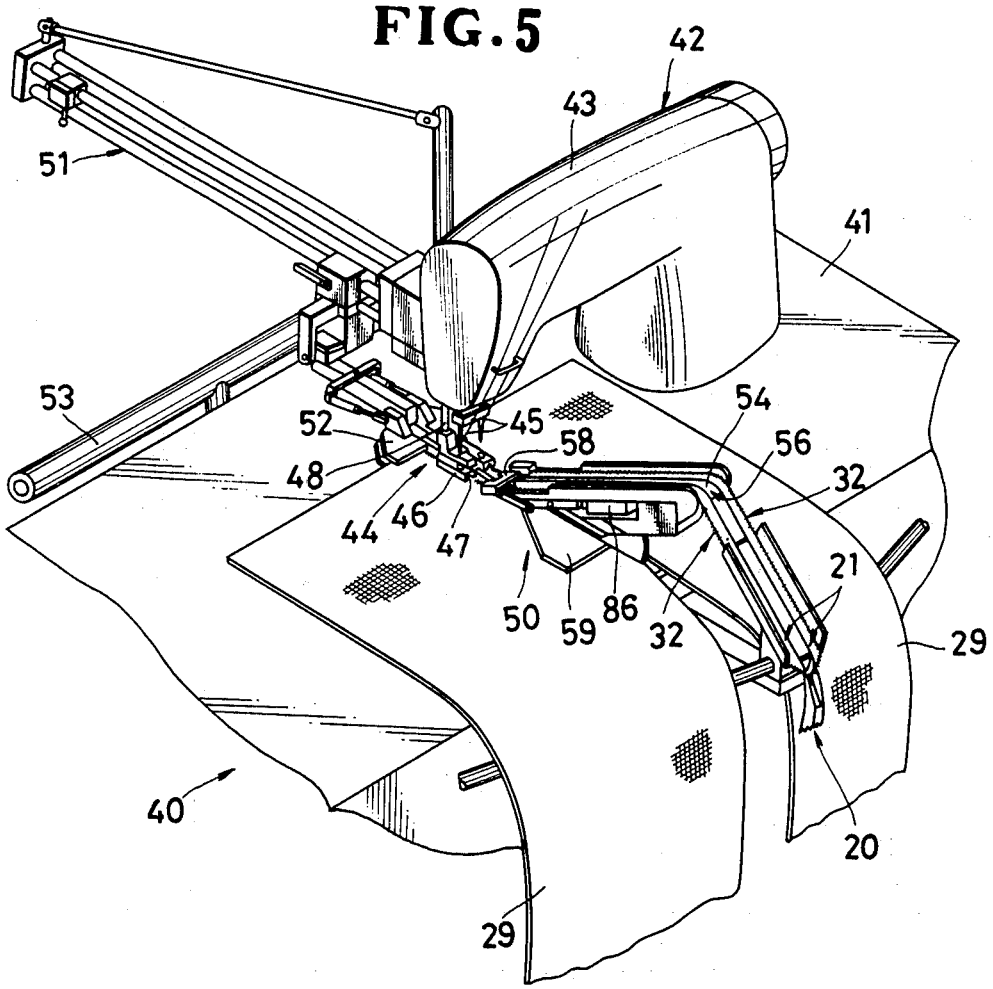
FIG. 5 is a fragmentary perspective view of a sewing machine having a device for guiding a concealed slide fastener to the sewing machine according to the present invention.

FIG. 5 illustrates a sewing machine, generally indicated by the reference numeral 40, for sewing the slide fastener stringers 21, 21 to the fabric pieces 29, 29, respectively. The sewing machine 40 has a bed 41 supporting thereon an arm assembly 42 including a horizontal arm 43 below which there is a sewing station or position 44. In the sewing position 44, there are a pair of parallel sewing needles 45, 45 vertically reciprocably mounted on the end of the horizontal arm 43, a presser foot 46 having a pair of downwardly opening grooves 47 (one shown in FIG. 6) and supported on a presser bar 48 mounted on the horizontal arm 43, and a thread cutter (not shown).

A guide device 50 according to the present invention is disposed on the bed 41 of the sewing machine 40 adjacent to the sewing position 44 for guiding the slide fastener stringers 21, 21 toward the sewing position 44. A tractor mechanism 51 is also disposed on the bed 41 in opposite relation to the guide device 50 across the sewing position 44 and has a grip 52 for gripping and pulling the fabric pieces 29, 29 at a rate at which the slide fastener stringers 21, 21 are progressively stitched. The tractor mechanism 51 is of a known construction and will not be described in detail. During operation of the sewing machine 40, the slide fastener stringers 21, 21 and the fabric pieces 29, 29 are fed in a direction from the guide device 50 toward the tractor mechanism 51 across the sewing position 44. A hanger rod 53 is positioned below the tractor mechanism 51 parallel to a rear edge of the bed 41 for hanging the fabric pieces 29, 29 to which the slide fastener stringers 21, 21 have been sewn.

Figure 6:
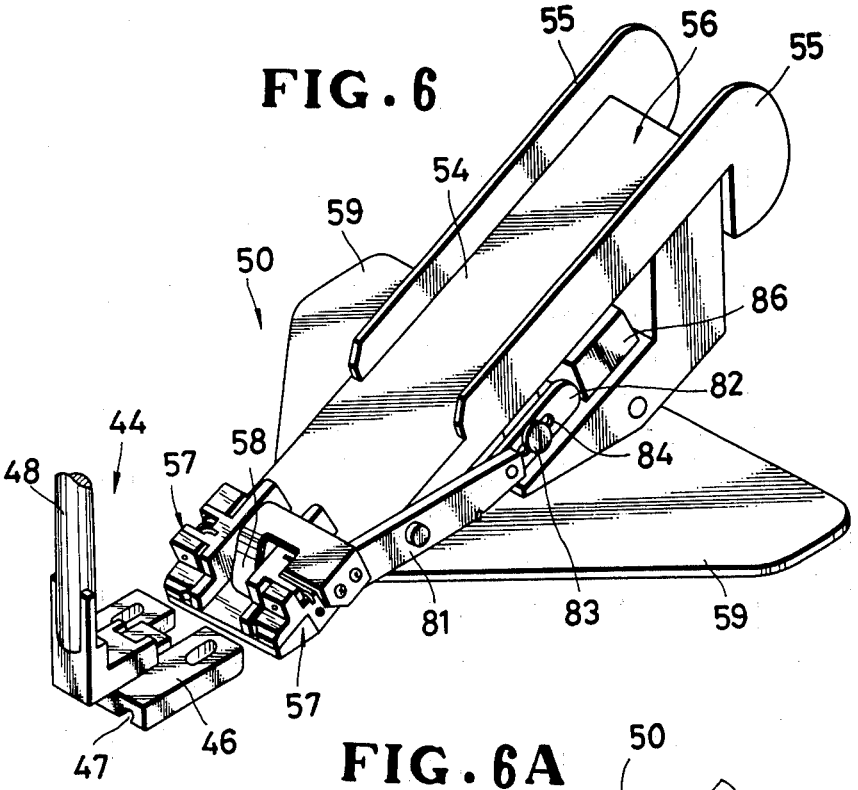
FIG. 6 is an enlarged perspective view of the guide device shown in FIG. 5.

As shown in FIGS. 5 and 6, the guide device 50 includes a slanted elongate guide plate 54 inclined progressively downwardly toward the sewing position 44 and having a pair of parallel spaced guard flanges 55, 55 extending along opposite longitudinal edges of the guide plate 54. The guide plate 54 and the guard flanges 55, 55 jointly define a path 56 of a constant width for guiding the slide fastener stringers 21, 21 to slide down toward the sewing position 44. The guide device 50 also includes a pair of track bodies 57, 57 laterally spaced from each other for guiding the element assemblies 32, 32, respectively, of the slide fastener stringers 21, 21. The track bodies 57, 57 are mounted on the end of the guide plate 54 closer to the presser foot 46. A stringer end sensor finger 58 is vertically movably disposed between the track bodies 57, 57. A pair of wings 59, 59 is disposed below the guide plate 54 and spaced vertically from the upper surface of the bed 41 in parallel relationship. The fabric pieces 29, 29 are inserted along their confronting edge portions between the sewing machine bed 41 and the wings 59, 59 while the fabric pieces 29, 29 are guided toward the sewing position 44.

Figure 6A:
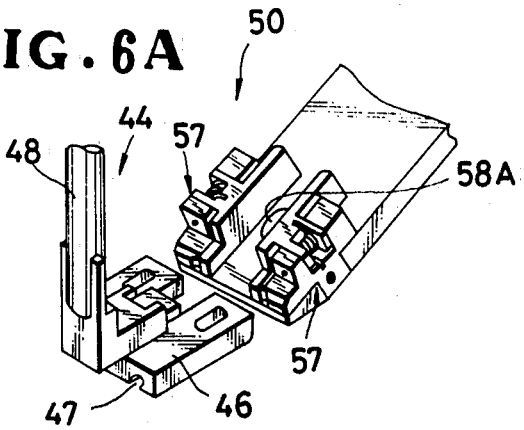
FIG. 6A is fragmentary perspective view of a modified guide device.
Figure 7:
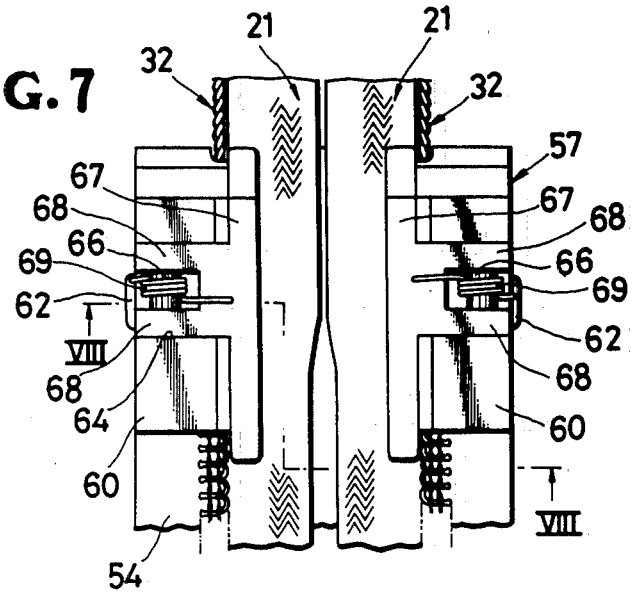
FIG. 7 is a plan view of the guide device.

FIG. 6A shows an alternative form of the stringer-end sensor which comprises a proximity switch 58A supported by one of the track bodies 57 for producing an electrical signal to the sewing machine 40 when the slider 26 at the end of the slide fastener 20 engages the switch 58A.

Figure 8:
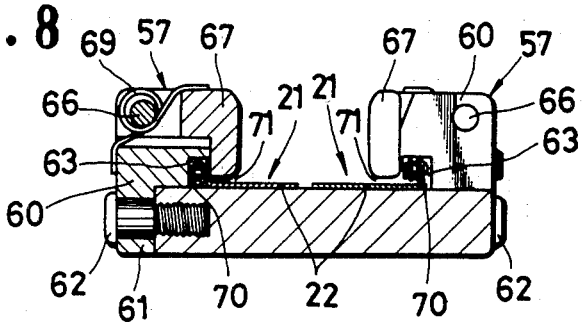
FIG. 8 is a cross-sectional view taken along line VIII—VIII of FIG. 7.

The track bodies 57, 57 are described in detail with reference to FIGS. 7 through 11. The track bodies 57, 57 comprise a pair of blocks 60, 60 elongated in the direction in which the slide fastener stringers 21, 21 are fed, the blocks 60, 60 being mounted on opposite marginal portions of the guide plate 54. The blocks 60, 60 have a pair of downwardly extending tongues 61, 61, respectively, fastened by screws 62, 62 to sides of the guide plate 54. The blocks 60, 60 have a pair of longitudinal grooves 63, 63 defined in inner lower corners, respectively, thereof in confronting relation to each other and extending the full length of the blocks 60, 60. Each of the blocks 60, 60 has a central recess 64 opening away from the bracket 61 to provide a pair of longitudinally spaced brackets 65, 65, as better shown in FIG. 11. A longitudinal hinge pin 66 extends through the brackets 65, 65 across the central recess 64 in each block 60. Each of the track bodies 57, 57 also includes a longitudinal cover member 67 swingably mounted on the block 60 and having a pair of legs 68, 68 pivotably mounted on the hinge pin 66 in the recess 64. A torsion spring 69 is disposed around the hinge pin 66 and has ends engaging the block 60 and the cover member 67 for normally urging the cover member 67 to swing in a direction to close the groove 63. The groove 63 in each block 60 is laterally closed by the cover member 67 to define a longitudinal guide channel 70 (FIG. 8) for guiding the element assembly 32. When the cover members 67, 67 are closed as shown in FIG. 8, there are small clearances 71, 71 between the lower edges of the cover members 67, 67 and the upper surface of the guide plate 54 for allowing the stringer tapes 22, 22 to pass therethrough.

Figure 11:
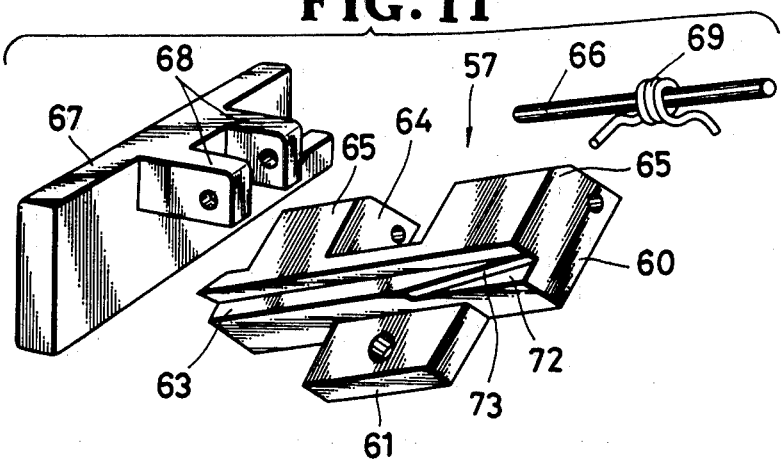
FIG. 11 is an exploded perspective view of a track body of the guide device.

As illustrated in FIG. 11, each block 60 includes a recess 72 defined in a side wall of the groove 63 by a downwardly facing slanted surface 73 extending from an upstream end of the block 60 and terminating at an intermediate position on the block 60 in parallel relationship to the upper surface of the guide plate 54. The slanted surface 73 has an upstream end positioned at an upper wall of the groove 63, is inclined progressively downwardly in a down-stream direction, and has a downstream end joined to a bottom wall of the block 60. The groove 63 and the recess 72 have an upstream inlet end large enough to accommodate therein the element assembly 32 as it lies horizontally. The groove 63 per se is of a cross section sized to accommodate therein the element assembly 32 as it is erected vertically.

Figure 12A:
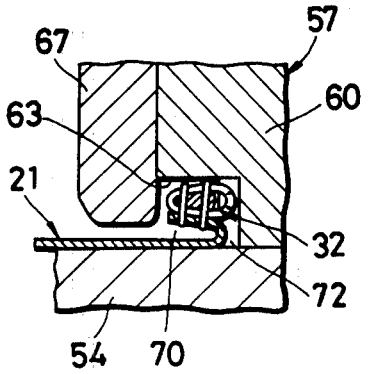
FIGS. 12A through 12C are fragmentary cross-sectional views showing the manner in which an element assembly is progressively erected in the track body.
Figure 12B:
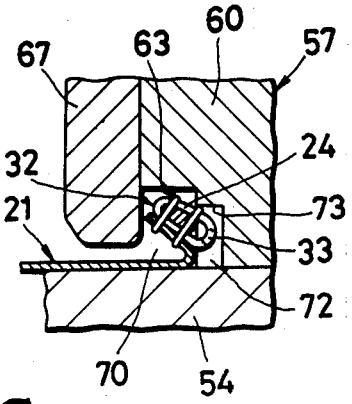
Figure 12C:
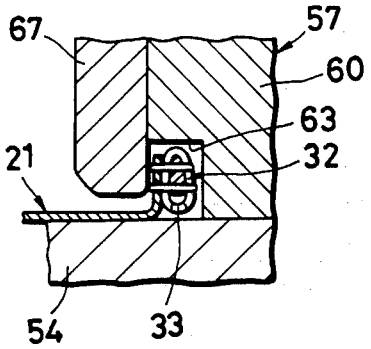

For feeding the concealed slide fastener stringers 21, 21 to the sewing position 44 on the sewing machine 40, it is necessary to that the element assemblies 32, 32 be erected or unfolded halfway (into the position of FIG. 3) to expose the fold line 31 (FIG. 3) so that the stringers 21, 21 can be sewn to the fabric pieces 29, 29, respectively, along the exposed fold 31. This requirement is met as follows: The element assembly 32 inserted in the guide channel 70 first lies substantially horizontally at the upstream inlet end thereof with the coupling heads 33 positioned in the recess 72 as shown in FIG. 12A. As the element asssembly 32 moves downstream along the guide channel 70, it is progressively raised by the slanted surface 73 of the recess 72 which engages the coupling elements 24 to tilt the coupling heads 33 downwardly as illustrated in FIG. 12B. When the element assembly 32 moves out of the recess 72, it is erected substantially vertically with the coupling heads 33 directed downwardly as illustrated in FIG. 12C. Therefore, the element assembly 32 is automatically tilted from the horizontal position to the erected position while it is moved through the guide channel 70, and is discharged out of the guide channel 70 toward the sewing position 44 while the element assembly 32 is kept in the erected posture.

Figure 9:
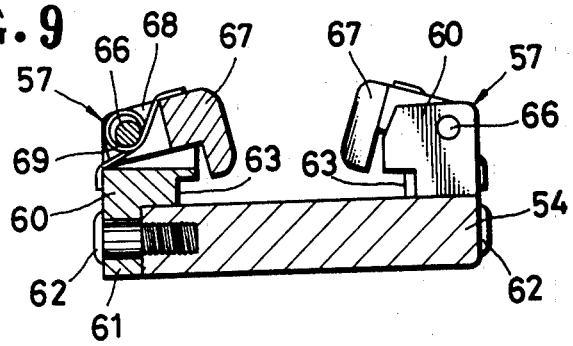
FIG. 9 is a view similar to FIG. 8, showing cover members raised to open guide channels.
Figure 10:
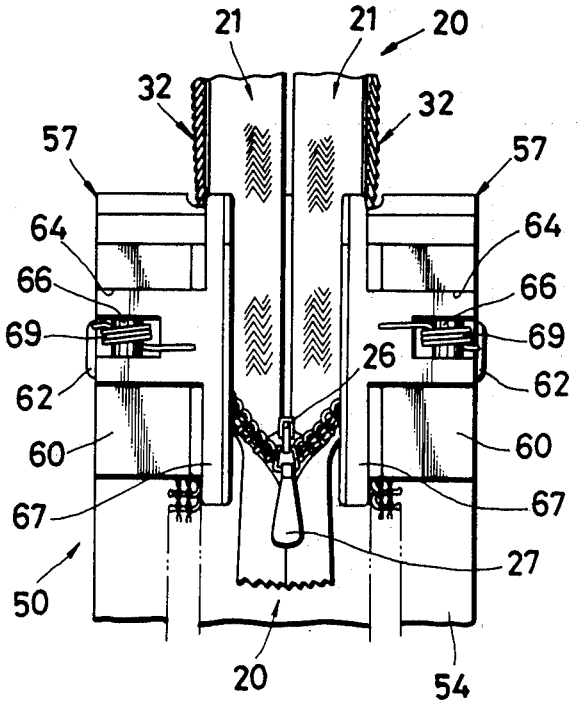
FIG. 10 is a plan view of the guide device, illustrating the manner in which a connected end of the concealed slide fastener passes through the guide device.

For attaching the assembled concealed slide fastener 20 to the fabric pieces 29, 29, the slide fastener 20 is opened by the slider 26 and then the slide fastener stringers 21, 21 are twisted around to direct the element assemblies 32, 32 away from each other into the position of FIG. 10. The element assemblies 32, 32 are then inserted into the guide channels 70, 70, respectively, in the downstream direction along the path 56 and then into the grooves 47 in the presser foot 56. Then, the sewing machine 40 is operated to stitch the slide fastener stringers 21, 21 to the fabric pieces 29, 29, respectively. As the end of the concealed slide fastener 20, where the slider 26 is positioned, reaches the guide device 50 as shown in FIG. 10, the cover members 67, 67 are angularly moved upwardly by the coupling elements 24, 24 which are disposed in a V shape at a connected end of the slide fastener 20 as shown in FIG. 10, to the position of FIG. 9 against the bias of the springs 69, 69, for thereby allowing the connected end of the slide fastener 20 to pass through the guide device 50 unobstructedly. Where independent slide fastener stringers with no slider thereon are to be delivered through the guide device 50, the cover members 67, 67 will not be lifted as shown in FIG. 9 and hence may be fixedly mounted of the blocks 60, 60.

Figure 13:
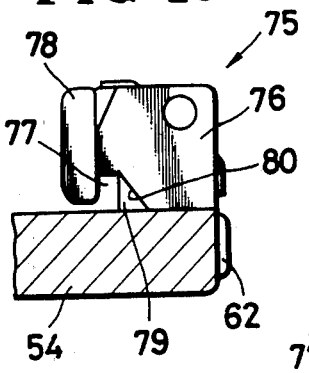
FIG. 13 is a front elevational view of a modified track body.
Figure 14:
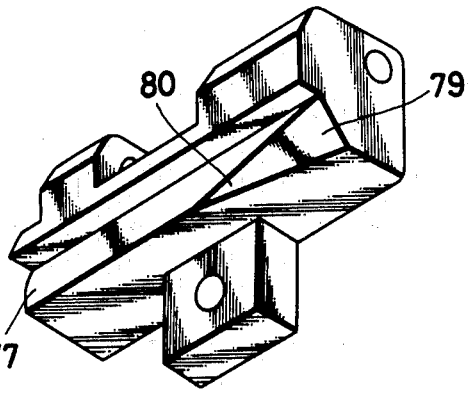
FIG. 14 is a perspective view of the modified track body.

FIGS. 13 and 14 illustrate a modified track body 75 according to the present invention. The track body 75 has a block 76 having a groove 77 normally closed by a cover member 78 and including a recess 79 defined by a slanted surface 80 in a side wall of the groove 77. The slanted surface 80 extends downstream obliquely with respect to the upper surface of the guide plate 54 and has a wide upstream end positioned at an upstream end of the block 76 and terminates in a sharply pointed downstream end positioned at an intermediate position of the block 76. The slanted surface 80 is substantially triangular in shape. The slanted surface 80 serves to erect the element assembly 32 progressively as it moves downwardly through the groove 77.

Figure 15:
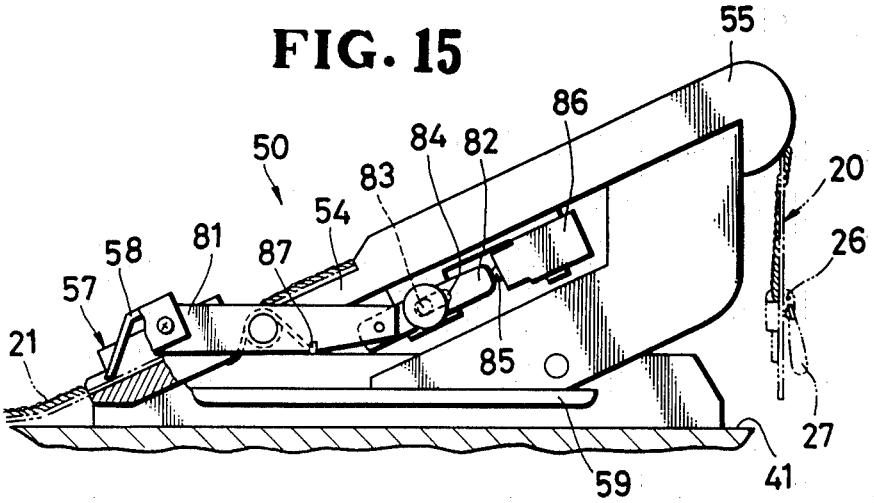
FIG. 15 is a side elevational view of a means for sensing the end of the concealed slide fastener.
Figure 16:
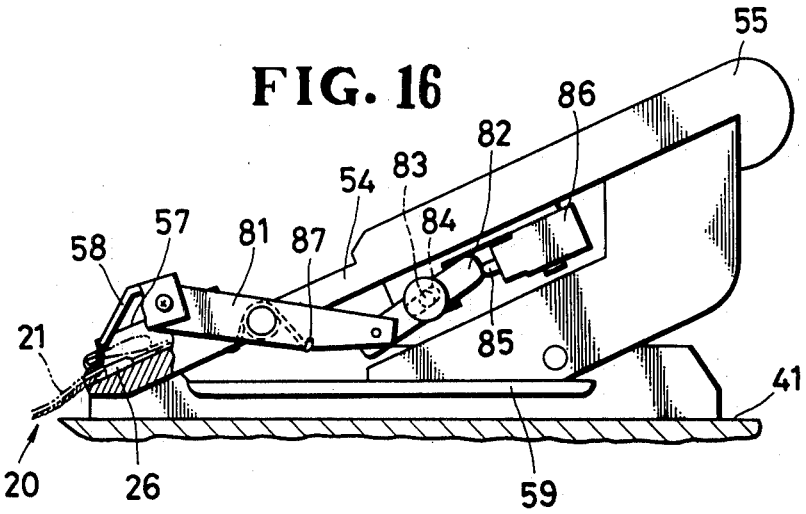
FIG. 16 is a view similar to FIG. 15, illustrating the sensing means as it has sensed the end of the concealed slide fastener.

As shown in FIGS. 6, 15, and 16, the stringer end sensor finger 58 is fixed to an end of a vertically pivotable lever 81 mounted at its center on a side of the guide plate 54. The opposite end of the pivotable lever 81 is pivotably coupled to an end of an actuating bar 82 movably mounted on a pin 83 extending through a longitudinal slot 84 defined in the bar 82 and fixed to the guide plate 54. The bar 82 has an opposite end held in contact with a contact rod 85 in a signal generator 86 mounted on a lower surface of the guide plate 54. The pivotable lever 81 is normally urged by a spring 87 to turn counterclock-wise (FIG. 16) for biasing the stringer end sensor finger 58 to move downwardly between the track bodies 57, 57. When the slider 26 on the slide fastener 20 reaches the guide device 50, the slider 26 is positioned between the track bodies 57, 57 and hence lifts the stringer end sensor finger 58 to turn the lever 81 clockwise against the spring 87. The bar 82 is pulled to actuate the signal generator 86, which generates a signal to stop and reverse the operation of the sewing machine 40 for sewing the end of the slide fastener 20 with finishing stitches.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A device for guiding a concealed slide fastener stringer having an element assembly including coupling elements with coupling heads to a sewing machine having a sewing position, comprising:

(a) a guide plate defining a path for feeding the concealed slide fastener stringer therealong toward the sewing position;

(b) a track body mounted on said guide plate in said path and comprising a block fixedly mounted on said guide plate and a cover member movably mounted on said block; and (c) said block and said cover member jointly defining a guide channel for guiding the element assembly therethrough while the concealed slide fastener stringer is fed along said path toward the sewing position, said guide channel including a recess for accommodating the coupling heads at an inlet end thereof, said recess being shaped for automatically erecting said element assembly from a horizontal position to a vertical position as the element assembly is moved progressively through said guide channel.

2. A device according to claim 1, said recess being defined by a slanted surface facing downwardly toward said guide plate in parallel relationship and inclined progressively downwardly toward said guide plate for engaging said coupling elements to direct said coupling elements progressively downwardly.

3. A device according to claim 1, said recess being defined by a slanted surface facing downwardly toward said guide plate obliquely thereto and inclined progressively downwardly toward said guide plate for engaging said coupling elements to direct said coupling elements progressively donwardly.

4. A device according to claim 1, said block having a tongue fastened to a side of said guide plate by a screw and a pair of brackets spaced from each other with a recess defined therebetween, and a hinge pin extending through said brackets in and across said recess, said cover member having a pair of legs mounted on said hinge pin in said recess, said track body further including a spring disposed around said hinge pin and engaging said block and said cover member for normally urging said cover member in a direction to close said guide channel.

5. A device for guiding a concealed slide fastener composed of slide fastener stringers each having an element assembly including coupling elements with coupling heads to a sewing machine having a sewing position, comprising:

(a) a guide plate defining a path for feeding the slide fastener stringers therealong toward the sewing position;

(b) a pair of spaced track bodies mounted on said guide plate in said path and each comprising a block fixedly mounted on said guide plate and a cover member movably mounted on said block;

(c) said block and said cover member of each track body jointly defining a guide channel for guiding the element assembly therethrough while the concealed slide fastener stringer is fed along said path toward the sewing position, said guide channel including a recess for accommodating the coupling heads at an inlet end thereof, said recess being shaped for automatically erecting said element assembly from a horizontal position to a vertical position as the element assembly is moved progressively through said guide channel; and (d) means on said guide plate for sensing an end of said concealed slide fastener.

6. A device according to claim 5, said means comprising a sensor finger movably disposed between said track bodies for sensing a slider on the end of the slide fastener, a signal generator mounted on said guide plate, and linkage means operatively connected between said sensor finger and said signal generator for actuating said signal generator in response to movement of said sensor finger upon sensing of the slider.

7. A device according to claim 6, said linkage means comprising a lever pivotably mounted on said guide plate and fixedly coupled to said sensor finger, and a bar movably mounted on said guide plate and pivotably coupled to said lever, said bar being held in operative engagement with said signal generator.

8. A device according to claim 5, said sensing means comprising a proximity switch supported on one of said track bodies for producing a signal when a slider on the end of the slide fastener approaches said proximity switch.

* * * * *